US008113599B2

(12) United States Patent
Klassen et al.

(10) Patent No.: US 8,113,599 B2
(45) Date of Patent: Feb. 14, 2012

(54) CABINET WITH MULTI-COMPARTMENT CABINET BODY

(75) Inventors: Samuel Klassen, Haiger (DE); Matthias Krüger, Breidenbach (DE)

(73) Assignee: Keba AG, Linz (AT)

( * ) Notice: Subject to any disclaimer, the term of this patent is extended or adjusted under 35 U.S.C. 154(b) by 725 days.

(21) Appl. No.: 11/547,223

(22) PCT Filed: Feb. 17, 2005

(86) PCT No.: PCT/EP2005/001607
§ 371 (c)(1),
(2), (4) Date: Sep. 26, 2008

(87) PCT Pub. No.: WO2005/106178
PCT Pub. Date: Nov. 10, 2005

(65) Prior Publication Data

US 2009/0021124 A1 Jan. 22, 2009

(30) Foreign Application Priority Data

Apr. 2, 2004 (DE) ..... 10 2004 016 239

(51) Int. Cl.
*E06B 3/50* (2006.01)

(52) U.S. Cl. ..... 312/109; 312/215; 312/222; 312/329

(58) Field of Classification Search ..... 312/109, 312/107, 306, 215–218, 220, 222, 326, 329
See application file for complete search history.

(56) References Cited

U.S. PATENT DOCUMENTS

| | | | | |
|---|---|---|---|---|
| 2,803,512 | A * | 8/1957 | Band | 312/298 |
| 4,128,064 | A * | 12/1978 | Chung et al. | 108/192 |
| 4,629,265 | A * | 12/1986 | Chester | 312/329 |
| 5,520,450 | A * | 5/1996 | Colson et al. | 312/215 |
| 5,902,025 | A * | 5/1999 | Yu | 312/109 |
| 6,695,418 | B2 * | 2/2004 | Skov et al. | 312/107 |
| 7,360,681 | B2 * | 4/2008 | Pittman et al. | 232/45 |
| 7,909,419 | B2 * | 3/2011 | Vinke | 312/215 |
| 2004/0140743 | A1 * | 7/2004 | Hinton et al. | 312/322 |

FOREIGN PATENT DOCUMENTS

DE 102 02 058 C1 6/2003

* cited by examiner

*Primary Examiner* — Janet M Wilkens
*Assistant Examiner* — Daniel Rohrhoff
(74) *Attorney, Agent, or Firm* — Pauley Petersen & Erickson

(57) ABSTRACT

A cabinet provided with a cabinet body having at least one vertical row of superimposed compartments which are separated by shelves and which can be opened and closed with compartment doors articulated on the cabinet. This invention simplifies and substantially reduces the cost of parts and of mounting the cabinet. Thus, a joint rod extending over a height of the cabinet body is assigned to each vertical row of compartments. The shelves are guided by a shoulder in the hinge zone having the joint rod and are fixed vertically on the joint rod by flange sleeves overlooking the upper and/or lower side of the shelves and their shoulder. The compartment doors which are adjusted to the heights of the compartments bear, on their rear surface, in the hinge zone, housings for the flange sleeves and can be covered with a shroud. The compartment doors can be installed, via the housings, on the flange sleeves oriented towards the compartment shelves and can be pivotally fixed on the flange sleeves by shrouds mounted on the compartment doors.

14 Claims, 3 Drawing Sheets

CABINET WITH MULTI-COMPARTMENT CABINET BODY

BACKGROUND OF THE INVENTION

1. Field of the Invention

This invention relates to a cabinet with a cabinet body that has at least one vertical stack of storage compartments situated one above another that are divided by compartment bottoms and are opened and closed by compartment doors hinge-mounted to the cabinet body.

2. Discussion of Related Art

The known cabinets require a considerable number of parts and a considerable amount of assembly effort for affixing the compartment bottoms in the cabinet body and for attaching the compartment doors to the cabinet body in a pivoting fashion. This is more complex when the storage compartments must be of different heights.

SUMMARY OF THE INVENTION

One object of this invention is to provide a cabinet of the type mentioned above but in such a way that the number of parts and amount of assembly effort required for affixing the compartment bottoms in the cabinet body and for hinge-mounting the compartment bottoms to the cabinet body are significantly reduced while maintaining the possibility for creating storage compartments of different heights.

This object is attained according to this invention if each vertical stack of storage compartments is associated with a hinge rod extending over the height of the cabinet body. The compartment bottoms are guided by a shoulder in the hinge region and are vertically mounted onto the hinge rod with flange bushings that protrude beyond the upper side and/or the lower side of the compartment bottoms and their shoulders. The compartment doors, which are matched to the heights of the storage compartments, have recesses for the flange bushings on their back sides in the hinge region, which can be covered by a cover. With recesses oriented toward the storage compartments the compartment doors can be placed onto the flange bushings and can be attached to the flange bushings in a pivoting fashion by the covers that are then mounted onto the compartment doors.

The flange bushings thus perform not only the function of affixing the compartment bottoms, but simultaneously also serve as hinge elements for the compartment doors. This eliminates the need for numerous functional parts on the cabinet body and the compartment bottoms. In addition, it simplifies and facilitates the hinge-mounting of the compartment doors to the cabinet body.

According to one embodiment, the hinge rod is mounted and spaced apart from the front side of a wall of the cabinet body or a vertical dividing wall of the cabinet body and is fastened by support elements to the front side of the bottom wall and top wall of the cabinet body. This makes the hinge locations of the compartment doors easily accessible.

According to one embodiment, the connection between the compartment bottoms and the flange bushings is such that the flange bushings are inserted snugly and in nonrotating fashion into openings in the shoulders of the compartment bottoms and the flange bushings have a through bore for the hinge rod.

If the through bore of the flange bushings and the outer diameter of the hinge rod are also matched to produce a press fit and the flange bushings are thus secured to the hinge rod in nonrotating fashion, then the compartment door can be easily pivoted on the hinge rod. It is also easier when constructing the cabinet to adapt the storage compartments to different heights and to close the storage compartments with correspondingly adapted compartment doors.

The compartment doors can be structurally designed in any number of ways. The compartment doors can be in the form of solid doors with recesses on the back for the flange bushings or the compartment doors can be in the form of basic boxes that are open at the back, with filling plates inserted into the back sides.

According to one modification, in order to close the storage compartments, the compartment doors have a closing element on the vertical side oriented away from the hinge side and when the compartment doors are closed, the closing elements contact counterpart closing elements that are attached to a vertical wall of the cabinet body or a vertical dividing wall of the cabinet body. An extremely wide variety of closing elements and counterpart closing elements can be used, which, in addition to the pure closing function, can also perform safety functions.

The alignment and adjustment of the compartment doors in relation to the storage compartments can be simply achieved if the compartment doors and/or the covers have fastener recesses embodied in the form of horizontal slots. It is thus possible to move and therefore adjust the compartment doors to a limited degree in the horizontal direction.

After the connection between the compartment doors and the double-walled cover is produced, access to the fastening points can be prevented by stoppers or the like.

BRIEF DESCRIPTION OF THE DRAWINGS

This invention is explained in detail in view of an embodiment shown in the drawings, wherein.

DETAILED DESCRIPTION OF THE INVENTION

Figure 1:
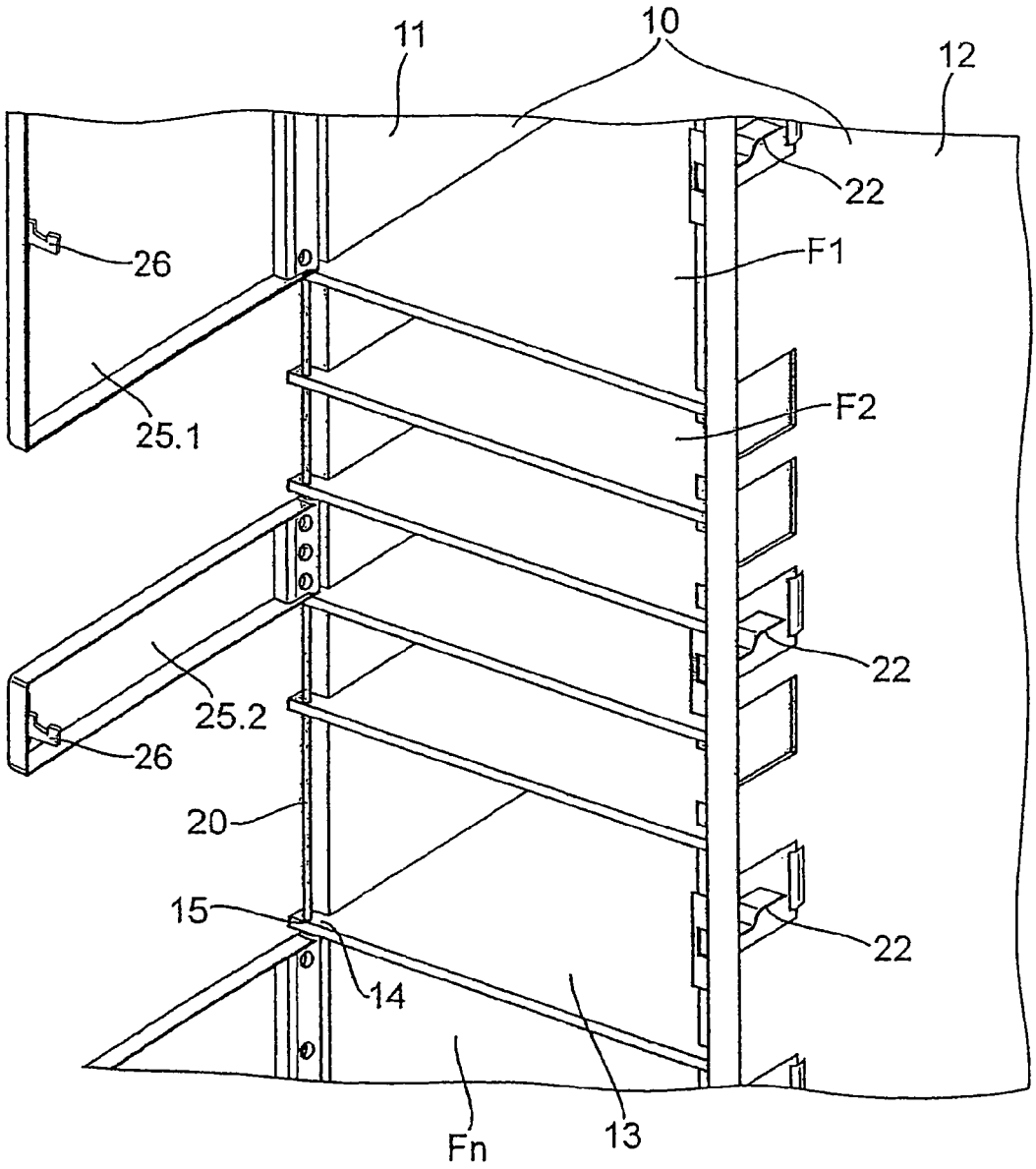
FIG. 1 is a perspective partial front view of a cabinet with a plurality of storage compartments divided by compartment bottoms and that can be closed by hinge-mounted compartment doors.

The cabinet shown in a perspective, partial front view in FIG. 1 has a cabinet body 10 comprising a vertical wall 11 and a dividing wall 12, and includes a vertical stack of storage compartments F1, F2, . . . , Fn. The stack is enclosed at the bottom by a bottom wall and is enclosed at the top by a top wall of the cabinet body 10. The cabinet body 10 can also have a plurality of the stacks of storage compartments F1, F2, . . . , Fn, which are then in turn enclosed on the right side with a wall 11 of the cabinet body 10.

Spaced apart from the front side of the wall 11, there is a hinge rod 20 extending over the entire height of the cabinet body 10, which is attached spaced apart from the front side of the wall 11. Thus, securing elements are fastened to the bottom wall and the top wall. Depending on the desired number and height, compartment bottoms 13 divide the space between the wall 11 and the dividing wall 12.

Figure 2:
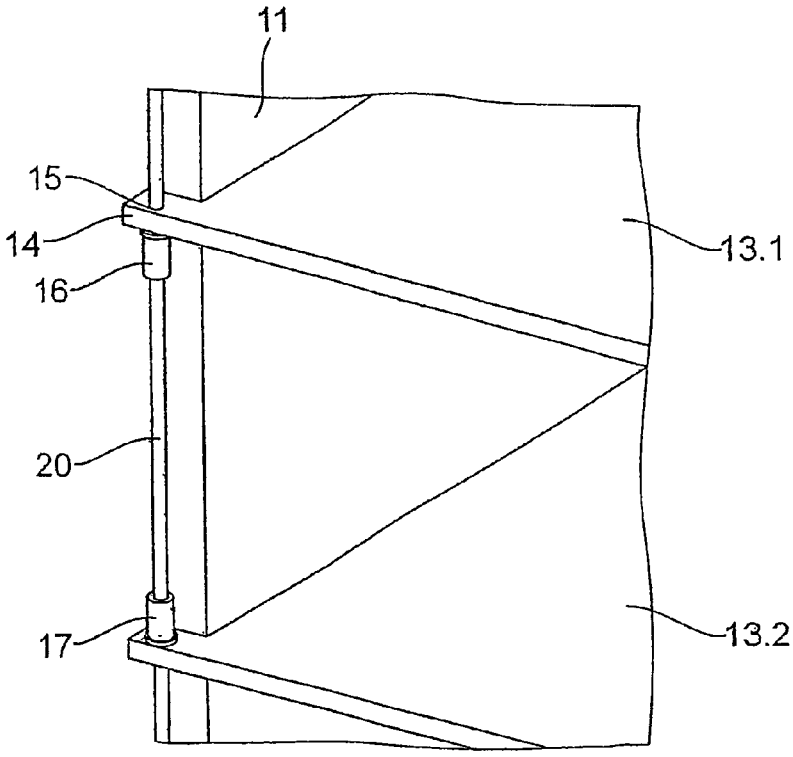
FIG. 2 is a perspective partial view with a hinge rod and affixed compartment bottoms.

As the perspective partial view according to FIG. 2 shows in detail, the compartment bottoms 13 protrude partially out from the cabinet body 10 and are guided by shoulders 14 in the hinge region with the hinge rod 20. The shoulders 14 have through bores 15 so that the hinge rod 20 can pass through them. Flange sleeves 16 and 17 are inserted into the through bores 15 and are preferably attached to the hinge rod 20 in a nonrotating manner or fashion. The through bores 15 of each of the compartment bottoms 13 can accommodate two respective flange bushings 16 and 17 that protrude from the upper and lower side of the compartment bottom 13. Because the flange bushings 16 and 17 with their bores for the hinge rod 20 are adapted to the outer diameter of the hinge rod 20 so that only a press-fit is possible, the flange bushings 16 and 17 can fasten the compartment bottoms 13 to any location on the cabinet body 10 or on a dividing wall 12 without requiring additional fastening elements. The division of the stack in the cabinet body can then be easily adapted to the desired number and height of compartments, as shown by the compartment bottoms 13.1 and 13.2 in FIG. 2.

As is already clear from FIG. 1, the storage compartments F1, F2, . . . , Fn are closed by individual height-adapted compartment doors 25.1 and 25.2, which are hinge-mounted to the hinge rod 20. On the vertical side oriented away from the hinge, the compartment doors 25.1 and 25.2 have closing elements 26 that can be brought into operative connection with counterpart closing elements 22 fastened to the dividing wall 12. It is thus possible to select any number of embodiments and to thus adapt the function and security of the closure to the desired requirements. The backs of the compartment doors 25.1 and 25.2 have recesses 29 in the region of the closing side so that they can be slid onto the flange bushings 16 and 17 that are affixed to the hinge rod 20 and protrude into a storage compartment F1, F2, or Fn. Then the recess 29 of the compartment door 25.1 or 25.2 is closed by a cover 30, thus completing the support for the flange bushings 16 and 17. If the cover 30 is attached to the compartment door 25.1 or 25.2, then the cover 30 is supported in a pivoting fashion on the flange bushings 16 and 17.

Figure 4:
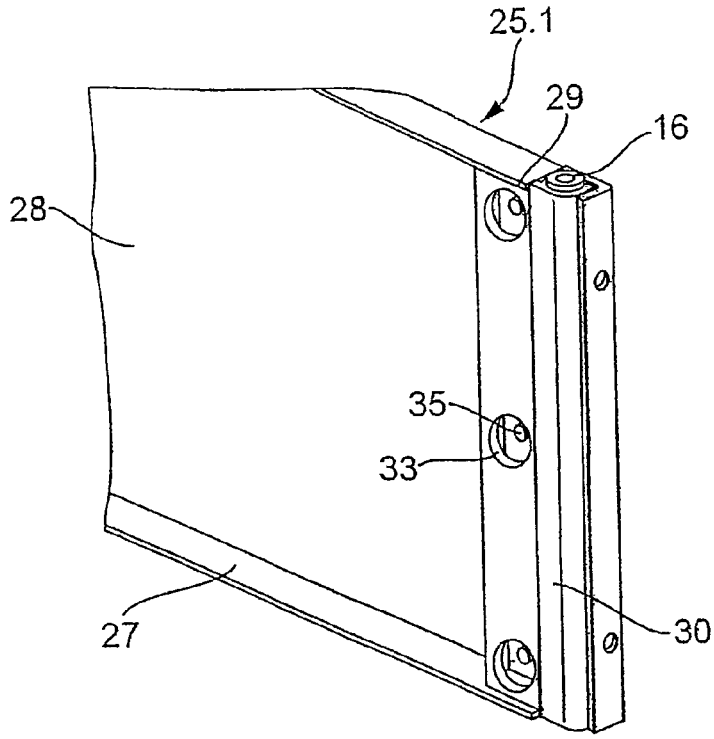
FIG. 4 is a perspective partial view of a hinge side of a compartment door with an attached cover.

This is shown in the view in FIG. 4, although the flange bushings 16 and 17 are shown in the finished support receptacles of the compartment door 25.1.

Figure 3:
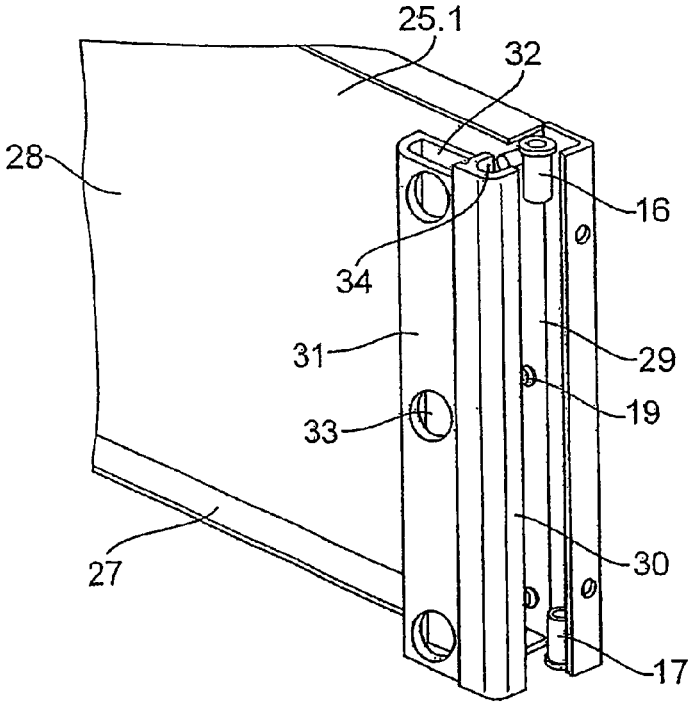
FIG. 3 is a perspective partial view of a back side of a compartment door, with a cover for forming the sockets for mounting the flange bushings on the hinge rod.

It should also be mentioned that the cover 30 can be embodied in the form of a profile section that can be embodied as double-walled (31, 32). As shown in FIG. 3, the addition 34 for producing the support receptacle for the flange bushings 16 and 17 is formed onto the wall 32. The cover 30 is fastened to the back side of the compartment door 25.1 by the fastening points 35 of the cover 30 and the fastening points 19 of the compartment door 25.1. The fastening points are embodied for cabinet connections. In the wall 31 of the cover, the fastening points 35 embodied in the form of horizontal fastening slots are situated in cup-like recesses 33 and are then covered by stoppers or the like after the connection is produced. The slot-shaped fastening points 35 can be used to horizontally align and adjust the compartment door 25.1.

This type of hinge-mounting of the compartment doors 25.1 and 25.2 has an advantage that the hinge rod 20 and the compartment bottoms 13 can already be assembled and aligned before the hinge-mounting of the compartment doors 25.1 and 25.2. The subsequent hinge-mounting of the compartment doors 25.1 and 25.2 onto the flange bushings 16 and 17 already affixed to the hinge rod 20 and the compartment bottoms 13 can then be carried out with little assembly effort.

Figure 5:
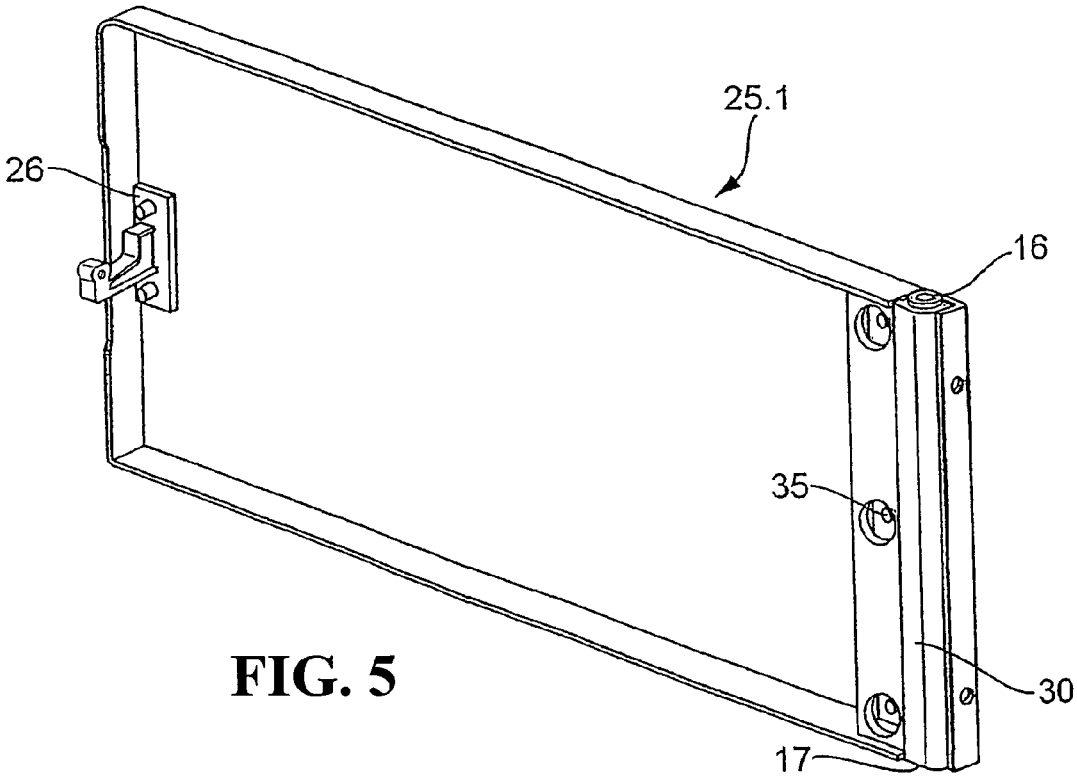
FIG. 5 is a perspective view that shows the compartment doors on the back side that has closing elements.

As also shown in FIGS. 4 and 5, this invention provides numerous possibilities for the construction of the compartment doors 25.1 and 25.2. The compartment door can be embodied in the form of a solid door plate or can be embodied in the form of a base part, which is open at the back and which has bent edges 27, into which a compartment plate 28 is inserted. In any case, as shown in FIG. 5, except for the flange bushings 16 and 17 and the cover 30, the compartment door 25.1 can be a prefabricated part and can be mounted onto the hinge rod 20 and, with the fastening of the compartment door 25.1 to the cover 30, can be hinge-mounted in pivoting fashion onto the flange bushings 16 and 17 affixed to the hinge rod 20.

The invention claimed is:

1. A cabinet with a cabinet body, having at least one vertical stack of storage compartments situated one above another and divided by compartment bottoms and are opened and closed by compartment doors hinge-mounted to the cabinet body, the cabinet comprising:

each of the vertical stack of storage compartments (F1, F2, Fn) associated with a hinge rod (20) extending over a height of the cabinet body (10), the compartment bottoms (13) guided by a shoulder (14) in a hinge region with the hinge rod (20) and vertically mounted onto the hinge rod (20) with flange bushings (16, 17) that protrude beyond at least one of an upper side and a lower side of the compartment bottoms (13) and shoulders (14), wherein the flange bushings (16, 17) are inserted snugly and in a nonrotating fashion into openings (15) in the shoulders (14) of the compartment bottoms (13), and the flange bushings (16, 17) have a through bore to accommodate the hinge rod (20), the compartment doors (25.1, 25.2) matched to heights of the storage compartments (F1, F2, Fn) and having recesses (29) for the flange bushings (16, 17) on back sides in the hinge region, which can be covered by a cover (30), and with the recesses (29) oriented toward the storage compartments (F1, F2, Fn) the compartment doors (25.1, 25.2) are positionable onto the flange bushings (16, 17) and attachable to the flange bushings (16, 17) in a pivoting fashion by the covers (30) mounted onto the compartment doors (25.1, 25.2).

2. The cabinet according to claim 1, wherein the hinge rod (20) is attached and spaced apart from one of a front side of a wall (11) of the cabinet body (10) and a vertical dividing wall (12) of the cabinet body (10) and is fastened to the front side of the bottom wall and the top wall of the cabinet body (10) by support elements.

3. The cabinet according to claim 2, wherein the through bore of the flange bushings (16, 17) and an outer diameter of the hinge rod (20) produce a press fit and the flange bushings (16, 17) are secured to the hinge rod (20) in a nonrotating fashion.

4. The cabinet according to claim 3, wherein one of the storage compartments (F1, F2, Fn) has a different vertical height from another of the storage compartments.

5. The cabinet according to claim 4, wherein the compartment doors (25.1, 25.2) are formed as solid doors with recesses (29) on a rear for the flange bushings (16, 17).

6. The cabinet according to claim 5, wherein the compartment doors (25.1, 25.2) are formed as boxes that are open at a back, with filling plates (28) inserted into back sides.

7. The cabinet according to claim 6, wherein the compartment doors (25.1, 25.2) have a closing element on a vertical side opposite from a hinge side and when the compartment doors (25.1, 25.2) are closed, the closing elements (26) contact counterpart closing elements (22) attached to one of a vertical wall (11) of the cabinet body (10) and a vertical dividing wall (12) of the cabinet body (10).

8. The cabinet according to claim 6, wherein at least one of the compartment doors (25.1, 25.2) and the covers (30) have fastener openings (15, 35) formed as horizontal slots.

9. The cabinet according to claim 1, wherein a through bore of the flange bushings (16, 17) and an outer diameter of the hinge rod (20) produce a press fit and the flange bushings (16, 17) are secured to the hinge rod (20) in a nonrotating fashion.

10. The cabinet according to claim 1, wherein one of the storage compartments (F1, F2, Fn) has a different vertical height from another of the storage compartments.

11. The cabinet according to claim 1, wherein the compartment doors (25.1, 25.2) are formed as solid doors with recesses (29) on a rear for the flange bushings (16, 17).

12. The cabinet according to claim 1, wherein the compartment doors (25.1, 25.2) are formed as boxes that are open at a back, with filling plates (28) inserted into back sides.

13. The cabinet according to claim 1, wherein the compartment doors (25.1, 25.2) have a closing element on a vertical side opposite from a hinge side and when the compartment doors (25.1, 25.2) are closed, the closing elements (26) contact counterpart closing elements (22) attached to one of a vertical wall (11) of the cabinet body (10) and a vertical dividing wall (12) of the cabinet body (10).

14. The cabinet according to claim 1, wherein at least one of the compartment doors (25.1, 25.2) and the covers (30) have fastener openings (15, 35) formed as horizontal slots.

* * * * *